US007726444B1

(12) United States Patent
Laughlin

(10) Patent No.: US 7,726,444 B1
(45) Date of Patent: Jun. 1, 2010

(54) EXHAUST SYSTEM BAFFLE APPARATUS

(76) Inventor: James C. Laughlin, 5085 Kennard Rd., P.O. Box 469, Seville, OH (US) 44273

( * ) Notice: Subject to any disclaimer, the term of this patent is extended or adjusted under 35 U.S.C. 154(b) by 0 days.

(21) Appl. No.: 12/123,277

(22) Filed: May 19, 2008

Related U.S. Application Data

(63) Continuation-in-part of application No. 10/940,854, filed on Sep. 13, 2004, now Pat. No. 7,374,017, which is a continuation-in-part of application No. 10/191,648, filed on Jul. 8, 2002, now Pat. No. 6,796,403.

(60) Provisional application No. 60/316,728, filed on Aug. 31, 2001.

(51) Int. Cl.
*F01N 1/12* (2006.01)

(52) U.S. Cl. ..... 181/279; 181/280

(58) Field of Classification Search ..... 181/279, 181/280
See application file for complete search history.

(56) References Cited

U.S. PATENT DOCUMENTS

| | | | | | |
|---|---|---|---|---|---|
| 1,157,256 | A | | 10/1915 | Schmitt | |
| 1,388,107 | A | | 8/1921 | Ernst | |
| 1,505,893 | A | * | 8/1924 | Hunter et al. | 181/253 |
| 1,612,584 | A | * | 12/1926 | Hunter et al. | 181/279 |
| 1,782,396 | A | * | 11/1930 | Aaron | 181/280 |
| 1,797,310 | A | * | 3/1931 | Wright | 181/280 |
| 1,957,012 | A | | 5/1934 | Haynes | |
| 2,063,270 | A | * | 12/1936 | Bacchetti-Righetti | 181/280 |
| 2,359,365 | A | * | 10/1944 | Katcher | 181/280 |
| 2,911,055 | A | | 11/1959 | McDonald | |
| 3,963,092 | A | * | 6/1976 | Soares | 181/268 |
| 4,050,539 | A | | 9/1977 | Kashiwara | |
| 4,147,230 | A | * | 4/1979 | Ormond et al. | 181/231 |
| 4,267,899 | A | * | 5/1981 | Wagner et al. | 181/272 |
| 4,361,206 | A | * | 11/1982 | Tsai | 181/255 |
| 4,368,799 | A | * | 1/1983 | Wagner | 181/255 |
| 4,667,770 | A | | 5/1987 | DeVane | |
| 4,683,978 | A | | 8/1987 | Venter | |
| 5,123,501 | A | * | 6/1992 | Rothman et al. | 181/239 |
| 6,006,859 | A | | 12/1999 | Hussaini | |

* cited by examiner

*Primary Examiner*—Jeffrey Donels
*Assistant Examiner*—Jeremy Luks
(74) *Attorney, Agent, or Firm*—Christopher L. Parmelee; Walker & Jocke

(57) ABSTRACT

An exhaust system baffle is provided comprising a tube and a plurality of radially extending flanges mounted in surrounding relation about the tube. Each flange includes a centrally positioned aperture and a slit that extends through the flange from the aperture to an outer edge of the flange. The tube extends through the apertures of the flanges. Each flange includes a first edge portion that bounds a first side of the slit. Each flange includes a second edge portion that bounds a second side of the slit opposite the first side of the slit. The opposed first and second edge portions of each flange are bent such that the opposed first and second edge portions are orientated to extend outwardly from the tube at angles that are each acute in opposed directions with respect to the central longitudinal axis of the tube.

13 Claims, 8 Drawing Sheets

EXHAUST SYSTEM BAFFLE APPARATUS

CROSS REFERENCE TO RELATED APPLICATIONS

This application is a continuation-in-part of U.S. application Ser. No. 10/940,854 filed Sep. 13, 2004 which is a continuation-in-part of U.S. application Ser. No. 10/191,648 filed Jul. 8, 2002 (now U.S. Pat. No. 6,796,403), which claim the benefit of U.S. provisional application Ser. No. 60/316,728 filed Aug. 31, 2001. The disclosures of these applications are incorporated herein by reference.

TECHNICAL FIELD

Embodiments of at least one invention described herein relate to exhaust systems for moving vehicles. Specifically, embodiments relate to an exhaust system baffle apparatus which is operative to dampen the noise level of an exhaust system and produce a unique and desirable exhaust sound.

BACKGROUND ART

Exhaust systems for moving vehicles are well known. In general, exhaust systems provide a means for dampening or muffling the noise level associated with exhaust gases exiting a combustion engine. However, different types of vehicles have different requirements for dampening the exhaust sound. For example, the object of racing vehicles is to move at a high rate of speed and win races. Because exhaust systems may limit the horsepower of an engine, racing vehicles often employ exhaust systems which minimize any loss of horsepower. As a result, racing exhaust systems tend to be excessively loud. On the other hand, passenger automobiles are designed to have a relatively low noise level for the exhaust system and typically employ mufflers to significantly dampen exhaust sounds. Other types of vehicles, such as sports cars, are often configured to have an exhaust sound with a noise level that is between the average automobile and the professional racing car.

Sports car enthusiasts often like to emphasize or "show off" their exhaust systems. One method of emphasizing an exhaust system is to mount exhaust pipes in locations that are readily viewable. For example, many "muscle cars" have exhaust pipes mounted on each side of the vehicle. Such side-mounted pipes may include a chromed outer surface to further emphasize the appearance of the exhaust system. Another method of emphasizing an exhaust system is to enhance the audible characteristics of the exhaust system. Such enhancements to the sound of an exhaust system may include raising the noise or volume level of the exhaust. Other enhancements may include changing the tone or range of tones of the exhaust system. For example, exhaust systems for "muscle" cars have been modified to produce deep, low frequency sounds. A deep sounding exhaust system is often intended to project to the listener that the car has a large and powerful engine. In addition, some exhaust sounds have such distinct qualities that manufacturers, such as Harley Davidson, have applied for trademark protection for the exhaust sounds of their vehicles.

For sports cars, various configurations of side pipe exhaust systems are available. However, the diversity of sounds produced by such systems is limited. As car enthusiasts desire methods of distinguishing their cars from the majority of other cars, there exists a need for an exhaust system which provides a unique sound that is deep in tone and dampened to meet legal and/or race track noise limitations.

Car enthusiasts often race their cars as a hobby. However, unlike their professional counterparts, car enthusiasts often require their cars to be used for general transportation in addition to racing. Thus there further exists a need for an exhaust system which both dampens the exhaust sounds to levels that are acceptable for general transportation needs, but minimizes the degradation of the power of the vehicle engine caused by restrictions to the flow of gases in the exhaust system.

Many modifications to exhaust systems require the replacement of large portions of the existing exhaust system to achieve the desired look, sound and performance for the vehicle. Unfortunately, such modifications may require custom bending of exhaust pipe and welding. Such modifications are both labor intensive and expensive. Thus, there exists a need for a method of modifying the sound and performance characteristics of an exhaust system, which can be performed relatively easily and quickly without the need for welding.

DISCLOSURE OF INVENTION

It is an object of an exemplary form of one or more embodiments of at least one invention described herein to provide an exhaust system for a vehicle.

It is a further object of an exemplary form of one or more embodiments of at least one invention described herein to provide an exhaust system which has a unique sound that is deep in tone.

It is a further object of an exemplary form of one or more embodiments of at least one invention described herein to provide an exhaust system with a sound volume level which is acceptable for public street transportation and/or for racing on a race track.

It is a further object of an exemplary form of one or more embodiments of at least one invention described herein to provide an exhaust system which reduces the exhaust system sound volume while minimizing degradation of engine power.

It is a further object of an exemplary form of one or more embodiments of at least one invention described herein to provide a method of producing or modifying an exhaust system to produce a unique exhaust sound that is deep in tone.

It is a further object of an exemplary form of one or more embodiments of at least one invention described herein to provide a method of producing or modifying an exhaust system to produce a sound volume which is acceptable for public street transportation and/or for racing on a race track.

It is a further object of an exemplary form of one or more embodiments of at least one invention described herein to provide a method of producing or modifying an exhaust system to produce an acceptable sound volume and to minimize degradation of engine power.

Further objects of exemplary forms of one or more embodiments of at least one invention described herein will be made apparent in the following Best Modes for Carrying Out Invention and the appended claims.

The foregoing objects are accomplished in an exemplary embodiment by an exhaust system baffle apparatus mounted within the exhaust pipes of a vehicle. The baffle apparatus may include an elongated tube with an exhaust gas blocking portion, such as a cap or other sealing device, mounted to the forward end of the tube. The exhaust gas blocking portion may be operative to direct at least portions of the exhaust gases to flow outside the tube rather than through the tube.

The baffle apparatus may further include a plurality of spaced apart flanges in surrounding relation around the tube. In the exemplary embodiment the flanges when mounted to the tube have an outer edge with a rounded contour and outer diameter that substantially corresponds to the inner circular contour and inner diameter of an exhaust pipe. The flanges may be in the form of a ring with a centrally located aperture and a radially extending slit. The slit extends from the aperture to an outer edge of the flange to give the flanges a C-shaped configuration. When mounted to the tube, the portions of each flange opposite the slit may extend radially from the tube and may be generally perpendicular to the tube. However, the opposed portions of each flange adjacent the slit may be curved generally away from each other and radially extend from the tube at non-perpendicular angles. For example, in an exemplary embodiment the edges of the flanges formed by the slits may extend in the radial direction at about 60 to 70 degree angles with respect to the longitudinal axis of the tube.

In an exemplary embodiment the C-shaped flanges may be formed by cutting a ring with a centrally located elongated aperture such as an elliptical or oval aperture from at least one planar piece of sheet metal. The flange is also cut to include a slit which extends from the aperture to the outer circumferential edge of the flange. The opposed edges of the flange adjacent the slit may then be bent apart, such that one portion of the flange extends below and a second portion of the flange extends above the original plane of the flange. The flanges may be welded to the tube in a predetermined relationship along the tube with the flanges being equally spaced apart. In an exemplary embodiment all of the flanges may be orientated in the same direction with respect to the tube. In addition, the flanges may be positioned along the tube with gaps between adjacent flanges. In further exemplary embodiments the flanges may be progressively angularly offset from each other. For example, rather than having each slit of each flange being aligned, each flange may be positioned at a different angular position around the tube.

In an exemplary embodiment at least two of the flanges may include a bracket member. The brackets are used to secure the apparatus to the inside of an exhaust pipe in an orientation in which the closed or capped end of the tube is positioned upstream with respect to the flow of exhaust gas and thus is positioned closer to the headers of the engine than the opposite end of the baffle apparatus. To mount the apparatus to an exhaust pipe, the apparatus may be placed adjacent the outside surface of the pipe. Holes may then be marked and drilled through the exhaust pipe at locations which correspond to the brackets of the apparatus. The apparatus may then be inserted through one end of the exhaust pipe, such that the holes in the brackets are aligned with the holes through the exhaust pipe. Bolts may then be inserted through the holes in the pipe and the brackets to secure the apparatus within the exhaust pipe. In one exemplary embodiment at least one of the brackets may include threaded portions, such as a weld nut, to receive a bolt.

In alternative exemplary embodiments the flanges may have other shapes, depending on the sound characteristics and baffling characteristics desired for the exhaust system. For example, an alternative shape for the flanges may include a spiral shape. In further exemplary embodiments the tube may include one continuous spiral-shaped flange which extends in surrounding relation along all or a portion of its length. In other exemplary embodiments, differently shaped flanges or flanges orientated in different directions may be attached to the tube to produce different sounds and performance characteristics of the exhaust system.

In further exemplary embodiments, the acoustical and dampening characteristics of the apparatus may be modified by perforating the tube and/or flanges with a plurality of relatively small holes. In addition, the acoustical and dampening characteristics of the apparatus may further be modified by placing relatively short slits through the flanges which do not extend all the way between the outer edge of the flanges and the aperture of the flanges.

BEST MODES FOR CARRYING OUT INVENTION

Figure 1:
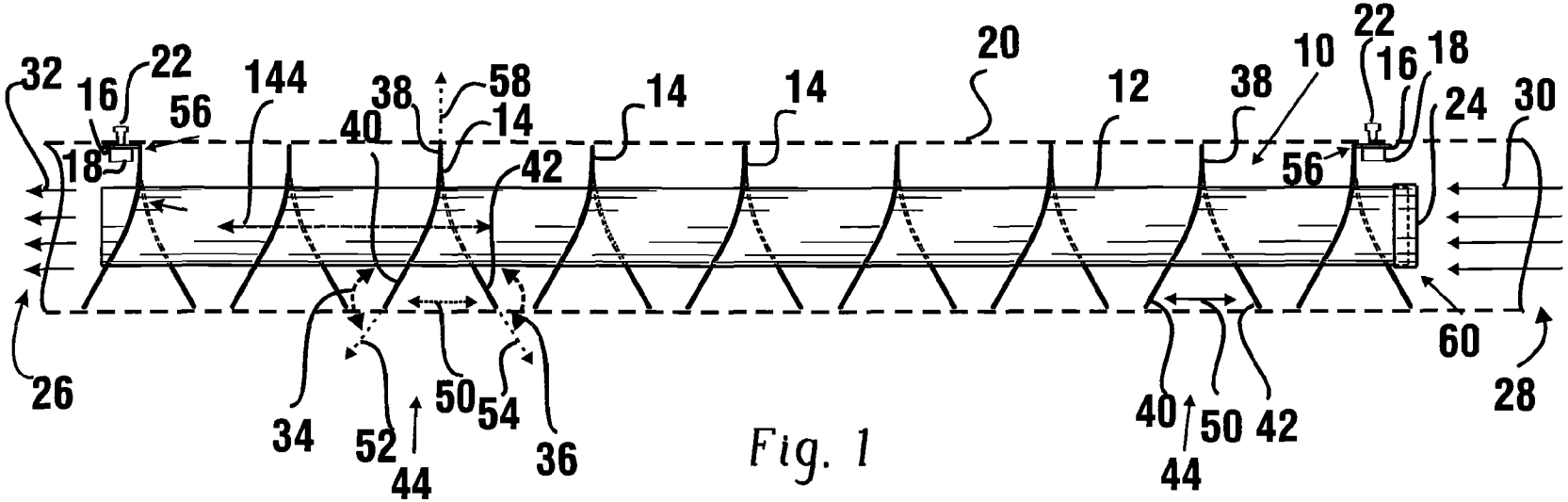
FIG. 1 is a top plan view of an exemplary embodiment of an exhaust baffle apparatus.

Referring now to the drawings and particularly to FIG. 1, there is shown therein a top plan view of an exhaust baffle apparatus 10 of an exemplary embodiment. The exemplary embodiment of the apparatus is adapted to be mounted within the interior portion of an exhaust pipe 20 of a vehicle with a combustion engine. When mounted within an exhaust pipe 20 in fluid communication with the headers of the engine, exhaust gases 30, 32 are operative to flow through the exhaust pipe adjacent the apparatus 10. The exemplary embodiment of the baffle apparatus 10 may be operative to both muffle the exhaust sound caused by the exhaust gas flows 30, 32 and produce a unique deep rumble tone.

For example, automobiles such as a General Motors 1967 Model Corvette, may include two side exhaust pipes with about 4 inch diameters. Exemplary embodiments of the baffle apparatus may be adapted to slide within each of the side exhaust pipes of the vehicle and be rigidly mounted to the inside walls of the side exhaust pipes. With the baffle apparatus mounted within both side pipes, the acoustical characteristics of the exhaust sound made by the vehicle may be both muffled and changed to a unique and distinctive tone.

Figure 3:
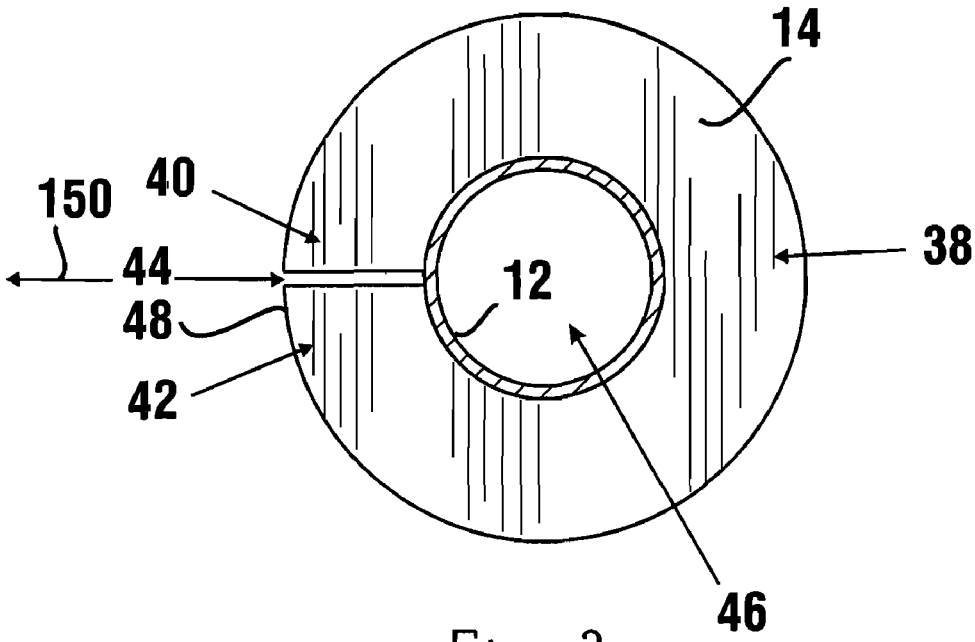
FIG. 3 is a cross-sectional view of the exhaust baffle apparatus.

An exemplary embodiment of the baffle apparatus 10 includes a tube 12. A plurality of flanges 14 may be mounted in surrounding relation about the tube 12. As shown in FIG. 3, a flange 14 may include a generally C-shaped configuration. The flange may include a centrally located aperture 46 and a radially oriented slit 44 which radially extends from the aperture 46 to an outside edge 48 of the flange 14. The aperture may have a size which is operative to accept the tube 12 therethrough. In an exemplary embodiment, the flanges 14 and the tube may be comprised of a low alloy steel. However, in alternative exemplary embodiments the flanges and tube may be comprised of other materials including a high alloy or stainless steel, or any other material which is operative to withstand the pressures, heat and vibrations associated with an exhaust system of a combustion engine. In an exemplary embodiment the flanges 14 may be welded to the tube 12. However, in alternative exemplary embodiments the flanges may be formed integral with the tube, such as with a molding or casting process.

The flanges 14 may include opposed portions 40 and 42 adjacent the slit 44. As shown in FIG. 1, these portions 40 and 42 may be spread apart a predetermined distance 50 in parallel with the longitudinal axis 144 of the tube 12 and may be angled in opposite directions 52, 54. As a result, the opposed portions 40 and 42 of the flanges 14 have angles 34 and 36 which may not be perpendicular to the longitudinal axis 144 of the tube. However, in an exemplary embodiment the portions of the flanges 38 opposite the slit 44 may generally extend from the tube in a radial direction 58 which is perpendicular to the tube. In an exemplary embodiment, the portions 40, 42 are spread apart a distance 50 which is operative to produce angles 34, 36 which range between from about 60 degrees to 70 degrees with respect to the longitudinal axis of the tube. To dampen the exhaust sound sufficiently for general transportation uses on public streets, exemplary embodiments of the baffle apparatus may include at least six of these described flanges mounted on a tube, where the end of the tube closest to the headers of the engine may be closed or partially covered with a cap.

Exemplary embodiments may be adapted for cars, trucks, or any vehicle that includes a combustion engine. For example, in a vehicle that includes a 4 inch exhaust pipe, an exemplary embodiment adapted for such an exhaust pipe may further include a tube with about a 30 inch length and about a 1¾ inch diameter. The tube may include about nine flanges with outer diameters that about correspond to the inner diameter of the 4 inch exhaust pipe. The gap between adjacent flanges may be about ⅝ inch.

For a vehicle, such as a truck that may include a 6 inch diameter exhaust pipe, an exemplary embodiment may include a tube with about a 67 inch length and about a 2 inch diameter. The tube may further include about 12 flanges with outer diameters that about correspond to the inner diameter of the 6 inch exhaust pipe. The gap between adjacent flanges may be about 1 inch. In these exemplary embodiments the flanges may be generally equally spaced apart in a generally uniform orientation to produce a muffled exhaust sound with a deep rumble tone.

In another embodiment in which the exhaust pipe includes about an 8.0 inch diameter, the tube of the apparatus may have a length of about 43.5 inches and an outer diameter of about 2.3 inches. The apparatus may further include six spaced apart flanges with outer diameters of about 7.99 inches.

In the described exemplary embodiments, each of the slits of the flanges may be generally aligned at the same angular positions with respect to the tube. However, in other exemplary embodiments the slits of the flanges may be orientated at different angular positions around the tube.

As shown in FIG. 3, the radial slit 44 of a flange corresponds to the radially oriented space between the opposed portions 40 and 42. Although, as shown in FIG. 1, the slit 44 is relatively wide as a result of the portions 40 and 42 of the flanges being spread apart, from the perspective shown in FIG. 3 each slit includes a radial orientation 150 which may be positioned at different angular positions around the tube 12.

Figure 5:
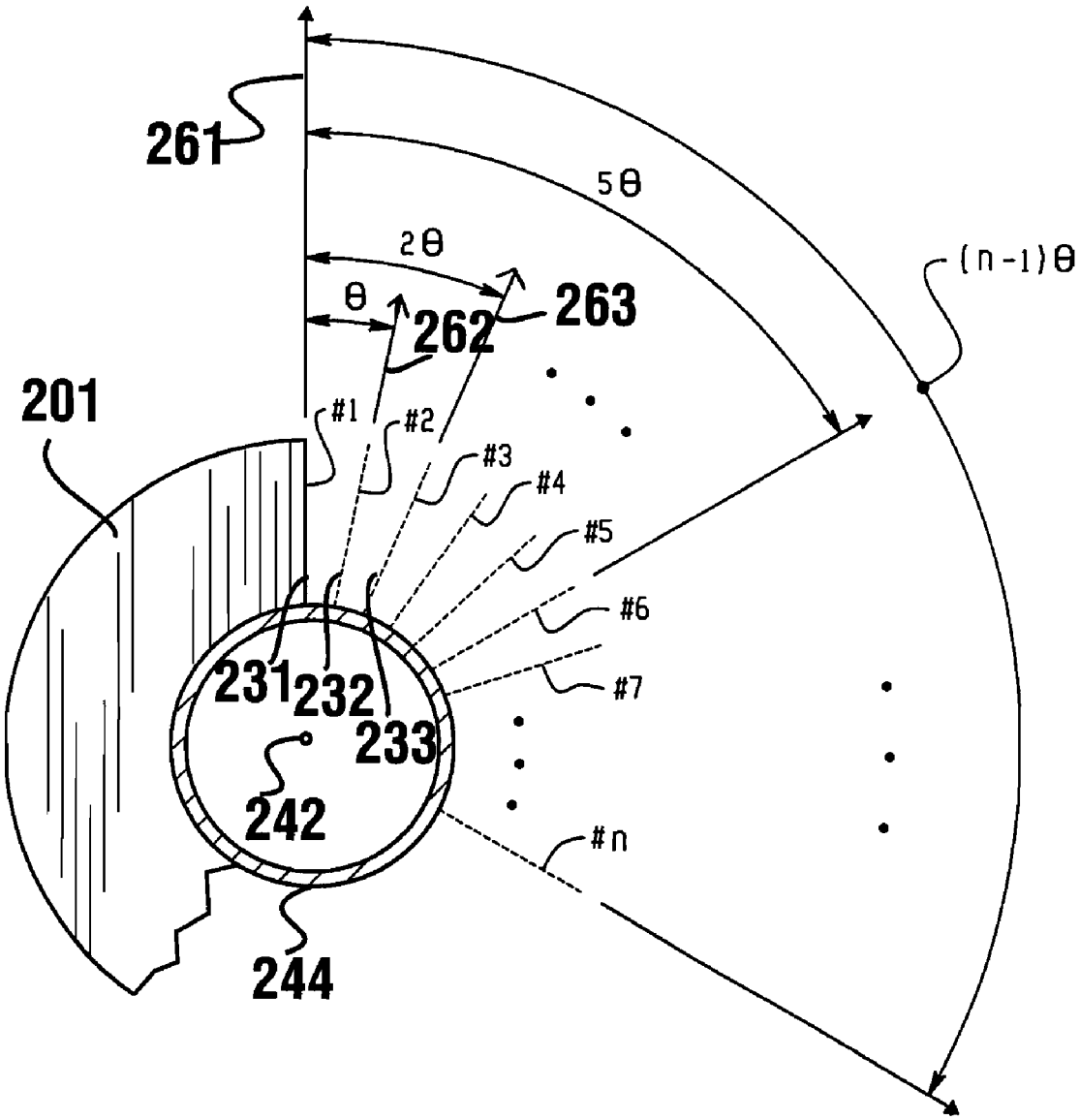
FIG. 5 is a schematic view showing flanges mounted at different angular positions around the tube of the apparatus.

For example, FIG. 5 shows a cross-sectional view of the apparatus facing into the longitudinal axis 242 of the tube 244. As shown in this view, the radial orientation 261 of a slit 231 in one flange 201 with respect to the tube 244 can be seen relative the slits 232, 233 of adjacent flanges. Here, first flange 201 may be mounted with its slit 231 in a first radial direction 261. The second flange adjacent the first flange may be mounted such that its slit 232 is orientated in a second radial direction 262 that is angularly offset from the first slit 231 by a predetermined angle θ. A third flange may be mounted such that its slit 233 is oriented in a third radial direction 263 that is angularly offset from the first slit 231 by about double the predetermined angle θ. Thus, in an exemplary embodiment each subsequent flange (n) may be angularly offset by (n−1)* θ relative the first flange. An exemplary embodiment of the apparatus shown in FIG. 5, for example, may have a predetermined angle of about 6 degrees. As a result, the radial direction of a slit of each flange may be angularly separated by about 6 degrees from the radial directions of slits of adjacent flanges immediately in front of and/or behind the flange.

In the exemplary embodiment shown in FIG. 5, the radial directions of the flanges progress around the tube in a uniform spiral formation. In other exemplary embodiments, the flanges may be angularly offset from each other at increasingly larger angles or decreasingly smaller angles. Further, alternating sets of flanges may have slits positioned in different angular orientations with respect to other sets of flanges. In exemplary embodiments, different patterns for orientating the positions of the slits may be used to achieve different acoustic, dampening and performance characteristics for the apparatus.

In addition, alternative exemplary embodiments may have less or more of the flanges and may have flanges which radially extend from the tube at other non-perpendicular angles. In alternative exemplary embodiments, the tube dimensions may be smaller or larger depending on the diameter and length of the exhaust pipe. In other exemplary embodiments, the upstream end of the tube closest to the headers of the engine may be only partially closed with a small aperture remaining that is smaller than the inner diameter of the tube. Further, in other exemplary embodiments the flanges may be positioned with or without gaps between edges and may be positioned such that the flanges partially overlap.

In an exemplary embodiment, at least two of the flanges may include brackets 16 adjacent the outer edges 56 of the flanges. The brackets 16 may be adapted for securing the apparatus to an interior portion of the exhaust pipe 20. To assist in the mounting of the apparatus, the brackets 16 may include a threaded portion 18, such as a weld nut, which is operative to receive a fastener 22, such as a threaded bolt. In an exemplary embodiment, brackets may be in operative connection with the portion 38 of the flanges opposed from the slits 44.

Figure 6:
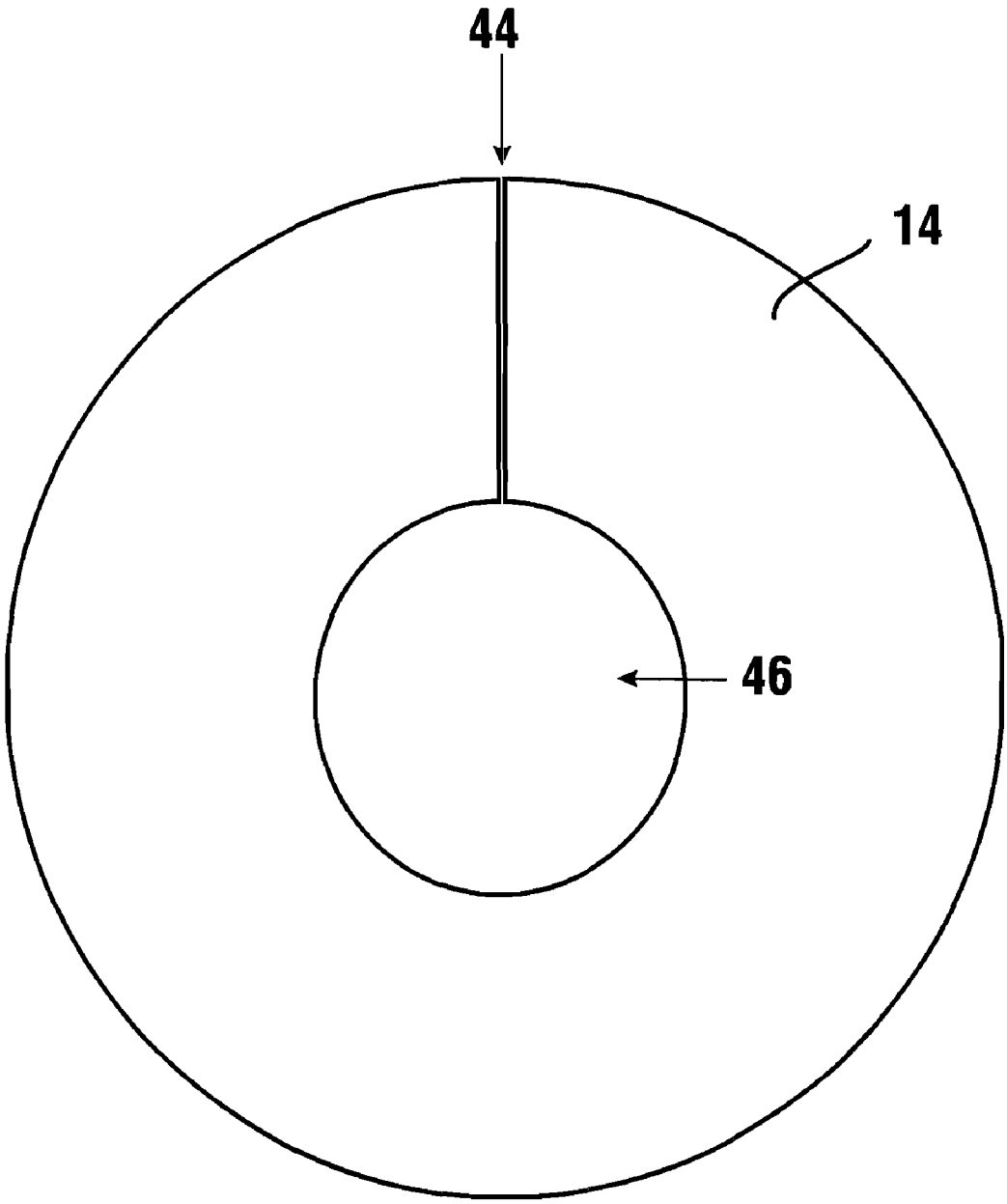
FIG. 6 shows a plan view of a flange in a planar configuration prior to being bent into a non-planar configuration.

In an exemplary embodiment, the flanges may be fabricated from planar sheet metal stock. This may be achieved by cutting out flanges from at least one sheet of metal which have an outer contour or circumferential edge that is elongated in one dimension relative a narrower perpendicular dimension (e.g. oval, elliptical shaped configurations). As shown in FIG. 6, the narrower dimension of the flange (e.g. the minor axis of an elliptical outer contour) may have a length which generally corresponds to the inner diameter of the exhaust pipe that the apparatus will be mounted therein. The elongated or larger dimension of the flange (e.g. the major axis of an elliptical outer contour) may have a length that is sufficiently larger than the inner diameter of the exhaust pipe so that when the flange is bent and mounted to the tube, the elongated dimension will have decreased in length to generally correspond to the inner diameter of the exhaust pipe.

Also, as shown in FIG. 6, the flanges 14 may further be cut to have the centrally located aperture 46 that is also elongated in one dimension relative a narrower perpendicular dimension (e.g. oval, elliptical shaped configurations). The narrower dimension of the aperture (e.g. the minor axis of an elliptical aperture) may have a length which generally corresponds to the outer diameter of the tube that the flanges will be mounted thereon. The elongated or larger dimension of the aperture (e.g. the major axis of an elliptical aperture) may have a length that is sufficiently larger than the outer diameter of the tube so that when the flange is bent and mounted to the tube, the elongated dimension of the aperture will have decreased to a length which generally corresponds to the outer diameter of the tube.

In the exemplary embodiment, the aperture and outer contour of each flange may be elongated in a common direction (i.e. the major axis of the elliptical outer contour of the flange is aligned with the major axis of the elliptical aperture of the flange). As used herein, the elongated dimension of a generally planar shape such as the outer circumferential edge/contour of a flange or the aperture of the flange before the flange is bent corresponds to the dimension of the shape which has the largest length for the shape and which is longer than a relatively narrower perpendicular dimension.

The flanges may be cut to include a slit 44 which radially extends from the aperture to the outer circumferential edge of the flange. The slit may be cut through each flange to be generally aligned with the direction of elongation of the outer contour and/or aperture of the flange. In further exemplary embodiments, the outer contour of the flanges may be cut to include a rectangular extension located opposite the slit. The rectangular extension may be bent at 90 degrees to produce an integral bracket for mounting the apparatus to the exhaust pipe.

The resulting planar C-shaped flange may be modified to have the non-planar configuration shown in FIGS. 1-4, by bending apart the opposed portions 40, 42 of the flange that are adjacent the slit 44 in generally opposite axial directions. As a result, opposed portions 40 and 42 are oppositely angled above and below the original plane of the flange. The resulting non-planar C-shaped flange may be welded to the tube at spaced apart intervals along the tube.

When mounted within an exhaust pipe, the front end 60 of the apparatus may be intended to be orientated upstream with respect to the flow of exhaust gases 30 and faces the input end 28 of the exhaust pipe. The input end 28 is the portion of the exhaust pipe 20 connected closest to the combustion engine and may be directly connected to the headers of the engine or may be connected to other exhaust devices, such as a catalytic converter. The exhaust gases 32 pass out of the output end 26 of the exhaust pipe 20 after flowing through the exhaust pipe and flowing adjacent the baffle apparatus 10. In some exemplary embodiments of exhaust pipes, the output end 26 of the exhaust pipe may include a curved portion to direct hot exhaust gases 32 away from the vehicle.

Figure 4:
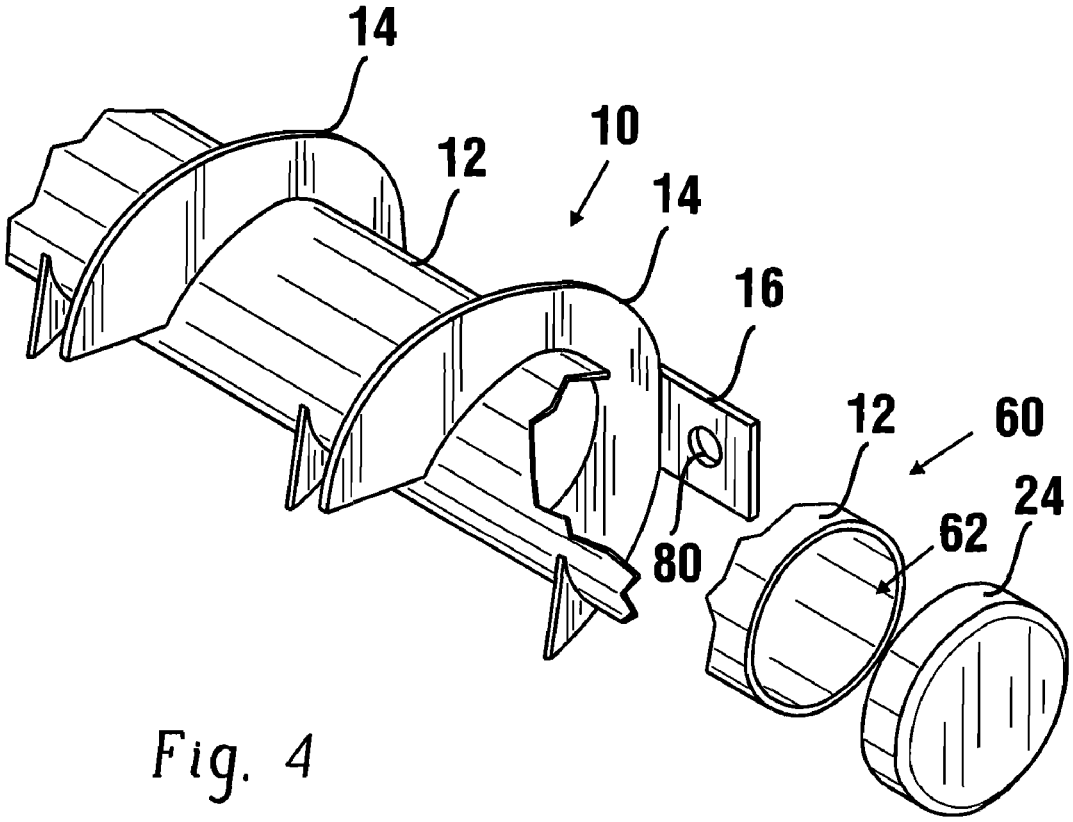
FIG. 4 is a perspective view of the front end of the exhaust baffle apparatus.

FIG. 4 shows a perspective and cut-away view of the front end 60 of the baffle apparatus 10. To achieve the desired muffling and audible characteristics, the opening 62 to the tube 12 at the front end 60 of the apparatus may be completely or partially closed off to prevent exhaust gases from passing through the tube 12. As a result, the exhaust gases may be directed to flow around the outside of the tube and across the flanges 14. In an exemplary embodiment an exhaust gas blocking portion 24, such as a cap, may be provided with the tube 12 at the front end 60 of the apparatus to at least partially close the opening 62 to the tube 12. In exemplary embodiments, the exhaust gas blocking portion 24 may be tapered with a concave and/or conical shape to more efficiently direct exhaust gases around the outside of the tube 12.

In an exemplary embodiment the exhaust gas blocking portion may include a cap that is operative to substantially seal the end of the tube. In other exemplary embodiments the exhaust gas blocking portion may not completely seal the end of the tube. Rather, the exhaust gas blocking portion may direct portions of the exhaust gases to flow outside the tube while allowing other portions of the exhaust gases to flow through the tube. For example, in one exemplary embodiment the exhaust gas blocking portion may include a cap with one or more apertures therethrough. In other exemplary embodiments the gas blocking portion may include the walls of the end of the tube being crimped or otherwise tapered together to completely or partially close the end of the tube.

Figure 2:
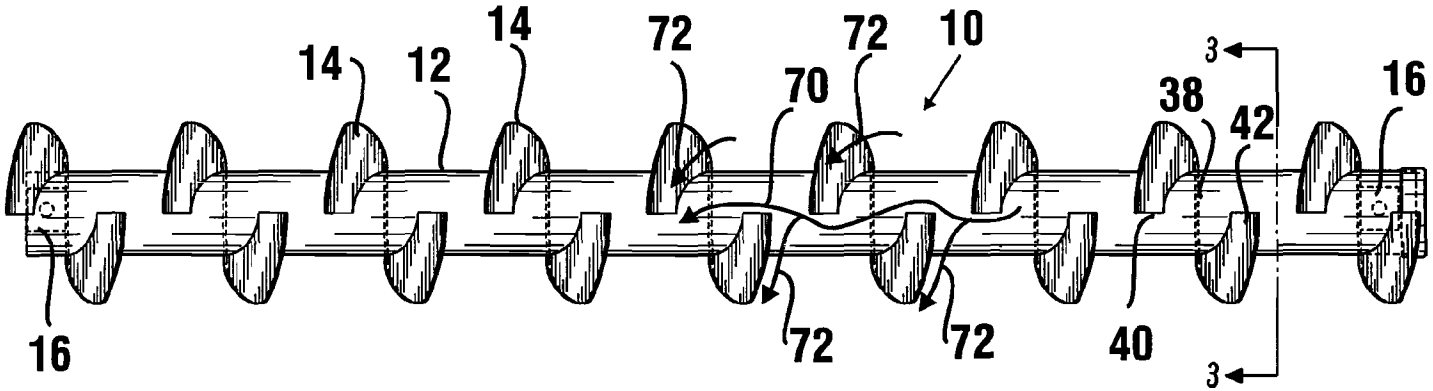
FIG. 2 is a side plan view of an exemplary embodiment of an exhaust baffle apparatus.

FIG. 2 shows a side view of the exemplary embodiment of the baffle apparatus 10. It is believed that the configuration and orientation of the flanges in the exemplary embodiment may be operative to direct exhaust gases to flow, both in a generally longitudinal direction 70 between the slits of the flanges and in a generally circular flow 72 around the tube. The resulting gas flows adjacent the described exemplary embodiment are operative to produce a muffled exhaust sound with a unique and desirable deep rumble tone.

In exemplary embodiments of the apparatus with flanges angularly offset as shown in FIG. 5, significant acoustical dampening is achieved with minimal degradation of horse power compared to the use of a hollow exhaust pipe.

In further alternative exemplary embodiments, the acoustical characteristics may be modified by perforating the flanges and/or the tube with small holes or slits. In further exemplary embodiments the acoustical characteristics may be modified by changing the curvature of the flanges to have a spiral or helical curvature. In further exemplary embodiments, the acoustical characteristics may be modified by increasing or decreasing the gaps between flanges. In other exemplary embodiments the acoustical characteristics may be modified by having single or multiple spiral flanges that include multiple loops around the tube.

Although alternative exemplary embodiments may be welded to the inside of an exhaust pipe, in the described exemplary embodiment the brackets enable the baffle apparatus to be easily installed and removed from an exhaust pipe with fasteners. Exemplary embodiments may include a novel method of installing the exemplary embodiment of the baffle apparatus in a pre-existing exhaust pipe. This method includes placing the described baffle apparatus next to, and in parallel with, an exhaust pipe such that the brackets are adjacent an outside surface of the wall of the exhaust pipe. To assist in aligning the baffle apparatus and the exhaust pipe, both may be placed on a level surface.

As shown in FIG. 4, the brackets 16 may include holes 80. By placing a marking device in the holes, marks may be produced on the outside surface of the wall of the exhaust pipe to mark the locations of the holes of the brackets. The baffle apparatus may then be removed from the exhaust pipe and holes may be drilled through the wall of the exhaust pipe at the marks.

The baffle apparatus is placed in the interior portion of the exhaust pipe by sliding and/or twisting the baffle apparatus through one end of the exhaust pipe. In the exemplary embodiment, the end of the tube that is not open is positioned upstream, with respect to the exhaust gas flow, to face the end of the exhaust pipe mounted closest to the engine.

The baffle apparatus is next positioned within the exhaust pipe to align the holes of the brackets with the holes drilled in the exhaust pipe. Fasteners may be mounted within the holes of the brackets and the holes drilled in the exhaust pipe to rigidly secure the apparatus to the exhaust pipe. The fasteners may include, for example, nuts, bolts and lock washers, or any other fastening device which is operative to securely fix the baffle apparatus to the exhaust pipe. As shown in FIG. 1, one or more of the brackets 16 may further include an integral threaded portion 18, such as a weld nut, which is operative to receive a threaded nut 22 in a cooperatively locking engagement.

Exhaust pipes may include one or more obstructions, such as excess welding material, indentations, bends, or other projections within the exhaust pipe which hinder the insertion of the baffle apparatus. As a result, the baffle apparatus may need to be rotated with respect to the exhaust pipe to pass one or more of the flanges around the obstruction within the exhaust pipe. In addition, one or more of the flanges may need to be shortened, such as by grinding, for example, to enable the baffle apparatus to slide completely within the exhaust pipe.

Figure 7:
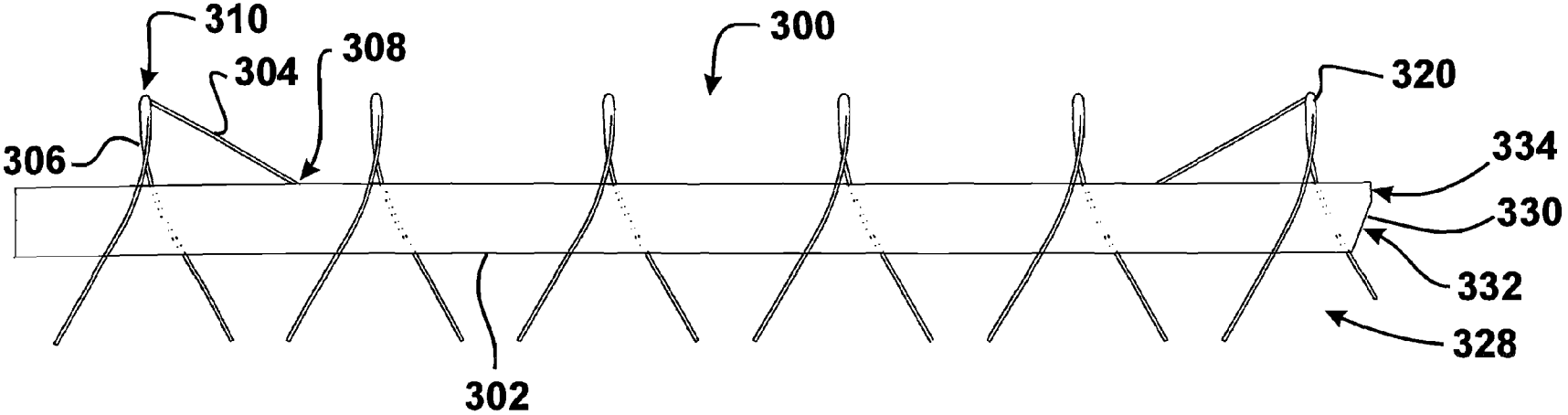
FIG. 7 is a top plan view of an alternative exemplary embodiment of an exhaust baffle apparatus.

FIG. 7 shows an alternative exemplary embodiment of the baffle apparatus 300. Here the apparatus may include at least one brace 304 which extends between the tube 302 and an outer edge of at least one of the flanges 306. In this described exemplary embodiment, the brace may include a bar, rod, rectangular sheet metal, or other bracing member which is welded or otherwise connected to a portion 308 of an outer surface of the tube 302 and a portion 310 of the flange. The portion 308 of the tube at which the brace is connected may be spaced apart from the portion at which the flange is connected to the tube.

Figure 8:
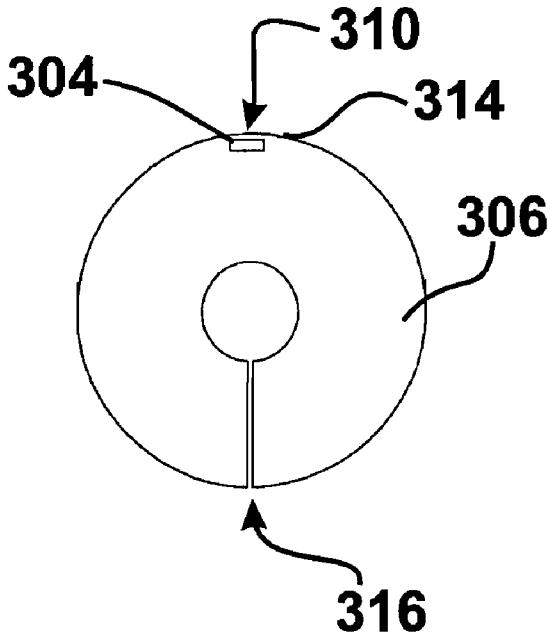
FIG. 8 shows the position of a brace mounted to a flange.

As shown in FIG. 8, in this described exemplary embodiment the portion 310 of the flange 306 at which the brace 304 is connected may be located on the opposite side of the flange as the slit 316 and may be located adjacent an outer edge 314 of the flange. However, in other exemplary embodiments, the brace may be connected to the flange at other portions of the flange.

Figure 9:
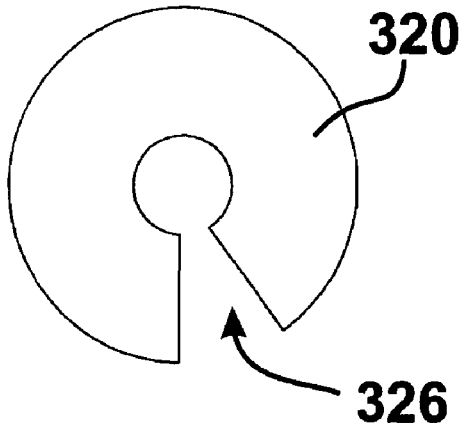
FIG. 9 shows an alternative exemplary embodiment of a flange.

As shown in FIG. 7, alternative exemplary embodiments may include braces connected to flanges 306, 320 adjacent each end of the apparatus. In addition, in exemplary embodiments, the flange 320 adjacent an end of the apparatus intended to be positioned upstream to receive the exhaust gas flow into the apparatus, may be cut to include a relatively larger slit than the previously shown slits such as shown in FIG. 8. For example, as shown in FIG. 9, the flange 320 may be cut to remove a generally pie shaped cut-out portion 326 in which the edges of the cut-out portion 326 extend radially at different angles with respect to a center point of the flange.

As shown in FIG. 7, after the flange 320 is bent as described previously and mounted to the tube 302, a relatively wider gap is formed 328 for gases to flow through the cut out portion 326 as compared to the gaps formed in the flanges with relatively narrower slits 316 such as shown in FIG. 8.

Alternative exemplary embodiments of the baffle apparatus may further include an end of the tube intended to be positioned upstream to receive the exhaust gas flow into the apparatus which includes a gas blocking member such as a cap 330. The edge of the tube and or the shape of the cap may be configured so that a surface 332 of the cap extends at an acute angle with respect to the longitudinal axis of the tube. In an exemplary embodiment, the angled surface of the cap may be operative to direct exhaust gases towards the gap 328 formed by the cut-out portion 326 of the flange. In further exemplary embodiments, the cap 330 may not cover the entire opening to the tube and as a result may leave a portion of the opening 334 uncovered to receive exhaust gases into the tube.

In exemplary embodiments, the baffle apparatus has been described as including a tube. However it is to be understood that in alternative exemplary embodiments, flanges may be mounted in surrounding relation about other support members which enable the flanges to remain aligned in fixed relation with each other inside an exhaust pipe. For example in alternative exemplary embodiments, the flanges may be mounted in surrounding relation about a metal rod, shaft or other support member. In other exemplary embodiments, the baffle apparatus may not include a tube or rod, rather, each of the flanges may be mounted to the inside surfaces of an exhaust pipe.

Further in alternative exemplary embodiments, the tube may have cross-sectional shapes other than circular. For example, the tube may have an oval cross-sectional shape. In such an exemplary embodiment, the flanges may be cut to include generally circular apertures in the planar configuration, which after being bent have a shape which corresponds to the oval shape of the tube. Also, in further exemplary embodiments, the tube may have a square or rectangular cross-section. As a result, the flanges may be cut to include generally square or rectangular apertures which when bent have a shape which corresponds to the square or rectangular shape of the tube.

Figure 10:
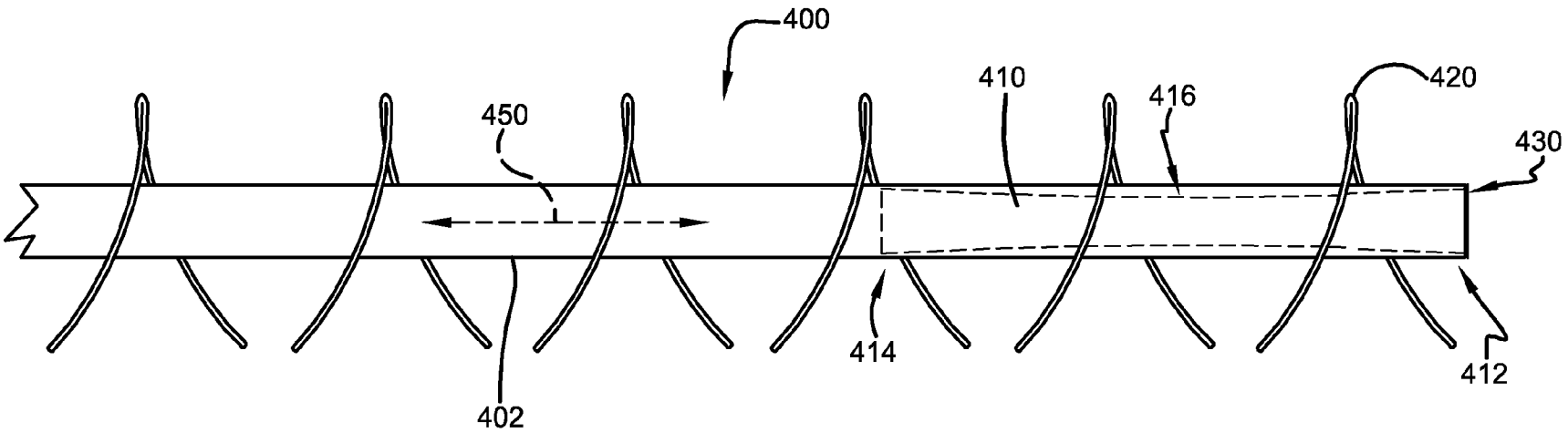
FIG. 10 shows a schematic view of an alternative exemplary embodiment of an exhaust baffle apparatus including a venturi.

FIG. 10 illustrates another exemplary embodiment of the baffle apparatus 400. In this embodiment the apparatus includes a venturi 410 that extends in the tube 402 of the baffle. As discussed in previous embodiments, the baffle apparatus 400 may include a central longitudinal axis 450. The tube includes an inner diameter through which exhaust gases may flow. In addition, the baffle apparatus 400 includes a plurality of radially extending flanges 420 mounted in surrounding relation about the tube 402. As discussed previously, each flange includes a centrally positioned aperture through which the tube extends. Each flange also includes a slit that extends through the flange from the aperture to an outer edge of the flange. Further each flange includes a first edge portion that bounds a first side of the slit, and a second edge portion that bounds a second side of the slit opposite the first side of the slit. As discussed previously, the opposed first and second edge portions of each flange are bent such that the opposed first and second edge portions are orientated to extend outwardly from the tube at angles that are each acute in opposed directions with respect to the central longitudinal axis 450 of the tube. Also as shown in FIG. 3, at least a portion of the opposed first and second edge portions of each flange may be spaced apart in a direction perpendicular to the central longitudinal axis of the support member.

As shown in FIG. 10, the venturi includes opposed ends 412, 414 and a middle portion 416 between the opposed ends. The middle 416 includes an inner diameter that is less than the inner diameters of the opposed ends 412, 414 of the venturi and is less than the inner diameter of the tube.

Figure 11:
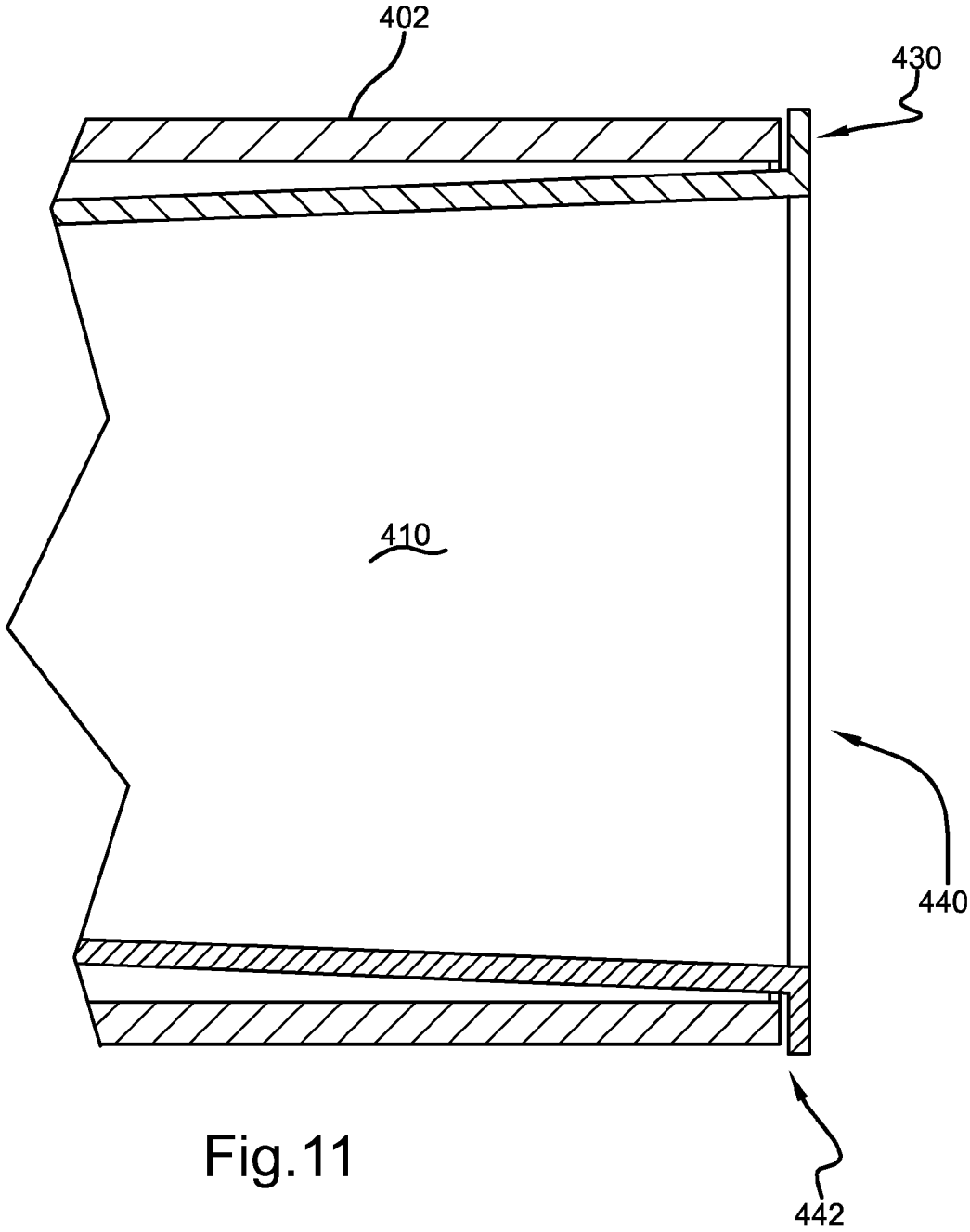
FIG. 11 shows a cross-sectional view of the venturi extending in the tube of the exhaust baffle apparatus.

As shown in FIG. 11, the venturi 410 may include an annular flange 430 at one of the ends of the venturi. The venturi may extend into an end 440 the tube such that the flange 430 of the venturi abuts the edge 442 of the end 440 of the tube. As shown in FIG. 10, to construct the described baffle, the end 414 of the venturi 410 without the flange, may be inserted into the tube 402 until the flange 430 abuts the edge of the tube 402. The flange may then be welded to the edge of the tube. Also, the tube may include one or more holes or a slot cut therethrough adjacent the location of the second end 414 of the venturi when fully inserted. The holes/slot may be positioned to enable a weld to be formed between the end 414 of the venturi and the tube 402 from outside the tube. Also, the described baffle 400 may be mounted inside an exhaust pipe such that the end 412 of the venturi that includes the flange 430 faces the input end of the exhaust pipe.

In embodiments of the described baffle 400, the venturi may have a length which is less than the length of the tube. In an embodiment, the venturi may extend a sufficient length into the tube to extend through the apertures of at least two flanges. For example in such an embodiment, the venturi may have a length of about 8.0 inches in a tube of a baffle with a length of about 30 inches and an inner diameter of about 1.75 inches. In addition the minimum diameter of the venturi may reduce the inner diameter by more than half. (e.g. the minimum inner diameter of the venturi may have a diameter of about 0.75 inches when mounted inside a tube with an inner diameter of about 1.75 inches. However, it is to be understood that in alternative embodiments, the venturi may have other minimum diameters and lengths depending on the size of the baffle and/or the desired balance between sound output and engine power reduction characteristics desired for the exhaust system/engine for which the baffle apparatus is used.

Thus, the new exhaust system baffle apparatus achieves one or more of the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention(s) is/are not limited to the exact details shown and described.

In the following claims, any feature described as a means for performing a function shall be construed as encompassing any means known to those skilled in the art to be capable of performing the recited function, and shall not be limited to the features and structures shown herein or mere equivalents thereof.

Having described the features, discoveries and principles of the invention(s), the manner in which it is constructed and operated, and the advantages and useful results attained; the new and useful structures, devices, elements, arrangements, parts, combinations, systems, equipment, operations, methods and relationships are set forth in the appended claims.

I claim:

1. An apparatus comprising:

an exhaust system baffle including:

a tube, wherein the tube includes a central longitudinal axis, wherein the tube includes an inner diameter;

a plurality of radially extending flanges mounted in surrounding relation about the tube, wherein each flange includes a centrally positioned aperture and a slit that extends through the flange from the aperture to an outer edge of the flange, wherein the tube extends through the apertures of the flanges, wherein each flange includes a first edge portion that bounds a first side of the slit, wherein each flange includes a second edge portion that bounds a second side of the slit opposite the first side of the slit, wherein the opposed first and second edge portions of each flange are bent such that the opposed first and second edge portions are orientated to extend outwardly from the tube at angles that are each acute in opposed directions with respect to the central longitudinal axis of the tube, wherein at least a portion of the opposed first and second edge portions of each flange are spaced apart in a direction perpendicular to the central longitudinal axis of the tube; and a venturi mounted in the tube, wherein the venturi includes opposed ends, wherein the opposed ends have inner diameters, wherein the venturi includes a middle portion between the opposed ends, wherein the middle portion includes an inner diameter that is less than the inner diameters of the opposed ends of the venturi and is less than the inner diameter of the tube.

2. The apparatus according to claim 1, wherein the venturi includes an annular flange at one of the opposed ends, wherein the tube includes opposed ends, wherein the venturi extends into one of the opposed ends of the tube such that the flange of the venturi abuts the opposed end.

3. The apparatus according to claim 2, wherein the venturi is welded to the tube at an end of the venturi that does not include the flange.

4. The apparatus according to claim 2, further comprising an exhaust pipe, wherein the exhaust pipe includes an input end that is adapted for connection with an exhaust portion of an engine and is operative to direct exhaust gases from the engine into the exhaust pipe, wherein the exhaust pipe further includes an output end that is operative to release exhaust gases flowing through the exhaust pipe, wherein the exhaust baffle is mounted inside the exhaust pipe such that the end of the venturi that includes the flange faces the input end of the exhaust pipe.

5. The apparatus according to claim 1, wherein the tube has a length, wherein the venturi has a length which is less than the length of the tube.

6. The apparatus according to claim 5, wherein the venturi extends a sufficient length into the tube to extend through the apertures of at least two flanges.

7. The apparatus according to claim 1, wherein the portions of the flanges opposite the slits extend radially from the tube at an angle that is about perpendicular to the tube.

8. The apparatus according to claim 1, wherein the slits of at least two of the flanges are orientated at a common angular position with respect to the central longitudinal axis of the tube.

9. The apparatus according to claim 1, wherein the slits of at least two of the flanges are orientated at different angular positions around the central longitudinal axis of the tube.

10. The apparatus according to claim 9 wherein the exhaust baffle includes at least three flanges mounted in surrounding relation about the tube, wherein the slits of the at least three flanges are oriented at different angular directions in a spiral progression around at least a portion of the tube.

11. The apparatus according to claim 10, wherein a first one of the flanges includes a slit oriented in a first radial direction with respect to the central longitudinal axis of the tube, wherein a second one of the flanges adjacent the first one of the flanges is oriented in a second radial direction with respect to the central longitudinal axis of the tube which is angularly offset from the first radial direction by a predetermined angle, wherein a third one of the flanges adjacent the second one of the flanges is orientated in a third radial direction with respect to the central longitudinal axis of the tube which is angularly offset from the first radial direction by about double the predetermined angle.

12. An exhaust system baffle comprising:

a tube, wherein the tube includes a central longitudinal axis, wherein the tube includes an inner diameter;

a plurality of radially extending flanges mounted in surrounding relation about the tube, wherein each flange includes a centrally positioned aperture and a slit that extends through the flange from the aperture to an outer edge of the flange, wherein the tube extends through the apertures of the flanges, wherein each flange includes a first edge portion that bounds a first side of the slit, wherein each flange includes a second edge portion that bounds a second side of the slit opposite the first side of the slit, wherein the opposed first and second edge portions of each flange are bent such that the opposed first and second edge portions are orientated to extend outwardly from the tube at angles that are each acute in opposed directions with respect to the central longitudinal axis of the tube, wherein at least a portion of the opposed first and second edge portions of each flange are spaced apart in a direction perpendicular to the central longitudinal axis of the tube.

13. The baffle according to claim 12, wherein the slits of at least two of the flanges are orientated at different angular positions around the central longitudinal axis of the tube.

* * * * *